US009206560B2

(12) United States Patent
Alfieri, III

(10) Patent No.: US 9,206,560 B2
(45) Date of Patent: Dec. 8, 2015

(54) EDGING SYSTEM FOR UNIT PAVEMENT SYSTEM

(71) Applicant: James A. Alfieri, III, Kirtland, OH (US)

(72) Inventor: James A. Alfieri, III, Kirtland, OH (US)

(73) Assignee: James A. Alfieri, III, Kirtland, OH (US)

( * ) Notice: Subject to any disclaimer, the term of this patent is extended or adjusted under 35 U.S.C. 154(b) by 0 days.

(21) Appl. No.: 14/627,337

(22) Filed: Feb. 20, 2015

(65) Prior Publication Data

US 2015/0252532 A1 Sep. 10, 2015

Related U.S. Application Data

(63) Continuation-in-part of application No. 14/199,005, filed on Mar. 6, 2014.

(51) Int. Cl.

| | |
|---|---|
| ***E02D 27/00*** | (2006.01) |
| ***E01C 11/22*** | (2006.01) |
| ***E01C 5/00*** | (2006.01) |
| ***E01C 9/00*** | (2006.01) |
| ***E01C 11/16*** | (2006.01) |

(52) U.S. Cl.

CPC . *E01C 5/005* (2013.01); *E01C 9/00* (2013.01); *E01C 11/16* (2013.01); *E01C 11/221* (2013.01); *E01C 2201/16* (2013.01)

(58) Field of Classification Search

USPC ..... 404/47, 68, 7

See application file for complete search history.

(56) References Cited

U.S. PATENT DOCUMENTS

| | | | | |
|---|---|---|---|---|
| 1,226,149 | A | 5/1917 | Warmoth | |
| 1,764,029 | A | 6/1930 | Miller | |
| 3,429,241 | A | 2/1969 | Burton | |
| 3,613,323 | A | 10/1971 | Hreha | |
| 4,710,062 | A | 12/1987 | Vidal et al. | |
| 5,212,917 | A | 5/1993 | Kurtz et al. | |
| 5,993,107 | A | 11/1999 | Bauer | |
| 6,099,201 | A * | 8/2000 | Abbrancati | 404/7 |
| 6,171,015 | B1 | 1/2001 | Barth et al. | |
| 6,185,893 | B1 | 2/2001 | Gaston | |
| 6,874,975 | B2 | 4/2005 | Hilfiker et al. | |
| 7,306,402 | B2 * | 12/2007 | Graber et al. | 405/121 |
| D586,005 | S | 2/2009 | Schumaker et al. | |
| 7,640,801 | B2 * | 1/2010 | Ohmayer et al. | 73/431 |
| 7,946,784 | B2 * | 5/2011 | Knak et al. | 404/2 |
| 7,963,718 | B2 | 6/2011 | Zwier et al. | |
| 7,967,524 | B2 | 6/2011 | Jones | |
| 8,266,844 | B2 | 9/2012 | Kurtz et al. | |
| 2006/0177267 | A1 * | 8/2006 | Carroll | 404/47 |
| 2006/0285922 | A1 * | 12/2006 | Centellas Oliveras | 404/47 |

(Continued)

*Primary Examiner* — Thomas B Will

*Assistant Examiner* — Katherine Chu

(74) *Attorney, Agent, or Firm* — Rankin, Hill & Clark LLP

(57) ABSTRACT

A method of installing an edging system for a unit pavement system includes inserting a main body section of a plate-like stake in a generally horizontal direction underneath at least one paver unit of the plurality of paver units and into a granular material layer upon which the unit pavement system is supported. The method further includes positioning a vertical section of an edge restraint under a horizontal cap section of the plate-like stake such that the vertical section of the edge restraint is arranged parallel to a vertical section of the plate-like stake and underneath a horizontal cap section of the plate-like stake. The method also includes driving a fastener into a ground surface until the fastener engages a horizontal section of the edge restraint. A plate-like stake including a main body section and a clip, which is separate from the main body section, is also disclosed.

20 Claims, 9 Drawing Sheets

(56) References Cited

U.S. PATENT DOCUMENTS

| | | | | |
|---|---|---|---|---|
| 2008/0163566 | A1 | 7/2008 | Bella | |
| 2009/0304456 | A1 | 12/2009 | Taylor et al. | |
| 2011/0173901 | A1 | 7/2011 | Runkles et al. | |
| 2012/0066969 | A1* | 3/2012 | van der Starre | 47/66.6 |
| 2013/0340330 | A1* | 12/2013 | DeSalle, Jr. | 47/29.6 |
| 2014/0339393 | A1* | 11/2014 | Ovitt et al. | 248/500 |
| 2014/0352208 | A1* | 12/2014 | Makropoulos | 47/31.1 |

* cited by examiner

EDGING SYSTEM FOR UNIT PAVEMENT SYSTEM

BACKGROUND

Unit pavement systems are made up of a plurality of paver units laid on a granular material, e.g., sand or stone aggregate. The paver units are made individually or in combination from a variety of materials such as concrete, clay, natural stone, asphalt, or synthetic materials. An "L-type" edge restraint system is the most popular edge restraint system used in the horizontal surface installation of unit pavement systems. The responsibility of the edge restraint system is to prevent the paver units from horizontal movement over time.

The L-type edge restraint is primarily anchored by nails, spikes, stakes or screws driven through fastener openings provided in a horizontal section, also referred to as the base flange, of the edge restraint and then into the granular sub-base below. The sub-base upon which the unit pavement system and the L-type edge restraint is installed typically extends beyond the edge of the unit pavement system a distance equal to the installed base depth. This provides for load transfer, edge restraint stability, and a base structure to hold the anchoring fasteners in place. There are typically two different types of installation techniques used when installing L-type edge restraints.

The first and most common installation method is referred to as exterior base flange placement. In this method, the base flange, or horizontal section, is installed on the outside of the edge of the unit pavement surface. Ten-inch steel spikes are then driven through fastener openings in the base flange and into the sub-grade below. The number of spikes needed varies depending on the load of the unit pavement system after installation.

The exterior base flange placement installation method is most preferred by installers because it allows the installation of the unit pavement system to be completed prior to edge restraint placement. This installation method also allows for the popular "rip cut" that is typically used by installers for time savings. A "rip cut" is defined as a cutting process used by the installer whereby the paver units are overlaid past a finished line, marked, and then cut along the finished line using a portable hand saw to form a finished edge of the unit pavement system. By not having the edge restraint in place, the paver units do not have a specific tolerance to meet along the perimeter of the unit paving system. This process requires less time in cutting labor and allows for a variance in the finished pavement edges or perimeters that is not available with an interior flange placement method that is to be discussed below.

When the "L-type" edge restraint is installed using the exterior base flange placement method, the edge restraint typically moves from its original position over time. The edge restraint is held in place by the vertical force on the spike as the spike is engaged with the sub-base and the weight of any backfill material on the base flange. Snow, rain, ground movement, traffic load, erosion, frost and terrestrial sub-base composition force the edge restraint and the spike to move both vertically and horizontally out of place. This can result in the spike and the edge restraint separating from the sub-base. In other cases, the spike can separate from the edge restraint. When either case occurs, the final result is a failure of the "L-type" edge restraint to stay in place making the edge restraint less effective in holding the paver units in place.

The second installation method for use with the "L-type" edge restraint is referred to as the interior base flange placement method. In this method, the base flange is installed facing toward the finished edge of the unit paving system. This installation is least preferred by installers because the edge restraint needs to be installed and anchored prior to the finished edge of the unit pavement system being installed. In this installation, the paver units must be individually cut and then placed in between the installed paver units and next to the vertical section of the already installed edge restraint. This method is much more time consuming than the exterior base flange placement method. The interior base flange placement method requires individually cutting paver units, precise measurement of edging placement, and results in additional labor time to fix units that do not line up with the edge restraint during installation.

With the interior base flange placement installation method, the weight of the paver units along the edge of the unit pavement system can help restrain the edge restraint from movement. One disadvantage with this method, however, is that the outer edges of the paver units along the edge of the unit pavement system sit on a different foundation structure, i.e., the base flange of the edge restraint, as compared to the remainder of the paver units along the edge, which sit on granular material. This causes the paver units along the edge to tip toward the interior of the unit pavement system. This tipping direction can cause water drainage issues because the free flow of water away from the unit pavement edge is impeded.

There is also another type of edge restraint generally referred to as a permeable pavement edge restraint. Permeable pavement edge restraints are primarily used for unit pavement systems that have a base composition made of larger aggregate materials having no small or fine particles. Such a base composition does not compact as densely as traditional aggregate. Since the material is open-graded and not finely compacted, the use of common fasteners, e.g., the 10-inch spike mentioned above, is unavailable because the common fasteners will not stay in place as they would in a traditional finer aggregate base. A geo-grid is typically installed on the sub-base prior to the unit pavers being installed. The permeable pavement edge restraints are then fastened to a capture plate or clip that holds the edge restraint to the geo-grid or base plate. Generally, this system requires additional labor and materials and is more costly than a typical L-type edge restraint system.

SUMMARY

In view of the foregoing, a novel method of installing an edging system for a unit pavement system will be described. The method includes inserting a main body section of a plate-like stake in a generally horizontal direction underneath at least one paver unit of the plurality of paver units and into a granular material layer upon which the unit pavement system is supported. The main body section of the plate-like stake is inserted until a vertical section of the plate-like stake contacts an edge of the at least one paver unit. The method further includes positioning a vertical section of an edge restraint under a horizontal cap section of the plate-like stake such that the vertical section of the edge restraint is arranged parallel to the vertical section of the plate-like stake and underneath the horizontal cap section. The method also includes driving a fastener into a ground surface until the fastener engages a horizontal section of the edge restraint.

An edging system for a unit pavement system includes an edge restraint and a plate-like stake configured to engage with the edge restraint. The edge restraint includes a horizontal section and a vertical section joined at a corner. The vertical section extends upwardly from and generally perpendicular to the horizontal section. The vertical section defines a paver-facing surface configured to face toward an edge of the unit pavement system. The plate-like stake includes a horizontal main body section sufficiently rigid so as to be inserted into coarse sand or aggregate underneath paver units of the unit pavement system. The plate-like stake includes a vertical section extending upwardly from the horizontal main body section and a horizontal cap section extending away from the vertical section and vertically offset from the horizontal main body section.

A plate-like stake for an edging system for a unit pavement system includes a main body section and a clip, which is separate from the main body section. The main body section is configured to be inserted beneath at least one paver unit of a plurality of paver units. The clip includes a vertical section and a horizontal cap section extending away from the vertical section. The clip and the main body section are configured to be connected such that the main body section extends away from the vertical section of the clip opposite the horizontal cap section.

DETAILED DESCRIPTION

Figure 1:
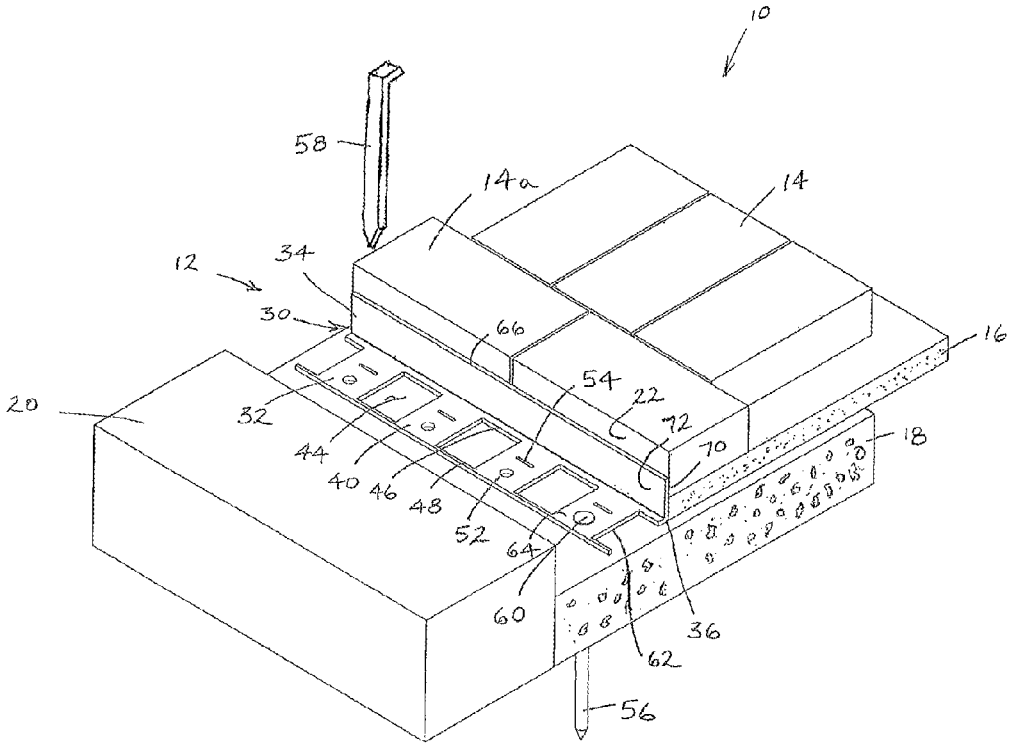
FIG. 1 is a perspective view of a unit pavement system and an edging system for retaining the unit paving system.

FIG. 1 depicts a unit pavement system 10 and an edging system 12 for retaining the unit pavement system. The unit pavement system 10 is made up of a plurality of individual paver units 14. The paver units 14 are laid on a granular material layer, which can be a sand layer 16 overlaying a crushed limestone layer 18. Other types of aggregate materials can also be used, which are known to persons of ordinary skill in the art. The sand layer 16 and the crushed limestone layer 18 are typically laid upon a compacted or virgin earth (not shown). The area where the unit pavement system 10 is to be installed can be excavated with the crushed limestone layer 18 and the sand layer 16 installed after excavation. The excavation can result in a finished grade 20 being located near an edge 22 of the unit pavement system.

The edging system 12 includes an edge restraint 30, which can have an L-shape, having a horizontal section 32 and a vertical section 34 joined at a corner 36. The edge restraint 30 is made from a rigid material, such as a rigid plastic, metal or composite material. Typically, the edge restraint 30 is an elongate member having a length much greater than a height and width.

The horizontal section 32, which can also be referred to as a base flange, of the edge restraint 30 rests on granular material (as shown in FIG. 1 the crushed limestone layer 18) when installed. The horizontal section 32 includes a plurality of anchoring sections 40 separated by respective voids 44. Each anchoring section 40 is made up of the material, e.g. rigid plastic, metal or composite material, from which the edge restraint 30 is made while the voids 44 are devoid of this material. The anchoring sections 40 are connected to one another by a proximal web 46, which is adjacent to the vertical section 34, and a distal web 48, which is spaced from the vertical section. Two adjacent anchoring sections 40, a respective proximal web 46 and a respective distal web 48 each surround a respective void 44. Fastener openings, such as a round fastener opening 52 and a rectangular fastener opening 54, extend through each anchoring section 40. Fasteners, such as a nail spike 56 and a flat nail stake 58, can be received in the respective openings 52, 54. The nail spike 56 is driven through the round fastener opening 52 until a head 60 of the nail spike 56 contacts the horizontal section 32. The horizontal section 32 defines a lower surface 62 of the edge restraint 30 that contacts the granular material, such as the crushed limestone layer 18. An upper surface 64 of the horizontal section 32 is typically covered with backfill after the installation of the edging system is completed.

The vertical section 34 of the edge restraint 30 extends upwardly from and generally perpendicularly to the horizontal section 32 to an upper edge 66 of the edge restraint 30. The vertical section 34 defines a paver-facing surface 70 configured to contact the edge 22 of the unit pavement system 10. The vertical section 32 also includes a backfill-contacting surface 72, which is typically covered by backfill when the installation is complete. The vertical section 34 extends upwardly from the horizontal section 32 about 1¾ inches in the illustrated embodiment, and the upper edge 66 of the edge restraint 30 is underneath the backfill when the installation of the unit pavement system 10 is completed.

The edging system 12 depicted in FIG. 1 shows the exterior base flange placement installation method described above. In an alternative arrangement, the edge restraint 30 could be situated so that the paver units **14*a* along the edge 22 are set on the horizontal section 32, making surface 72 of the vertical section 34 the paver-facing surface and surface 70 the backfill-contacting surface. Such an installation would be according to the interior base flange placement installation method discussed above. Each of these methods can result in undesirable movement of the edge restraint 30** over time.

Figure 2:
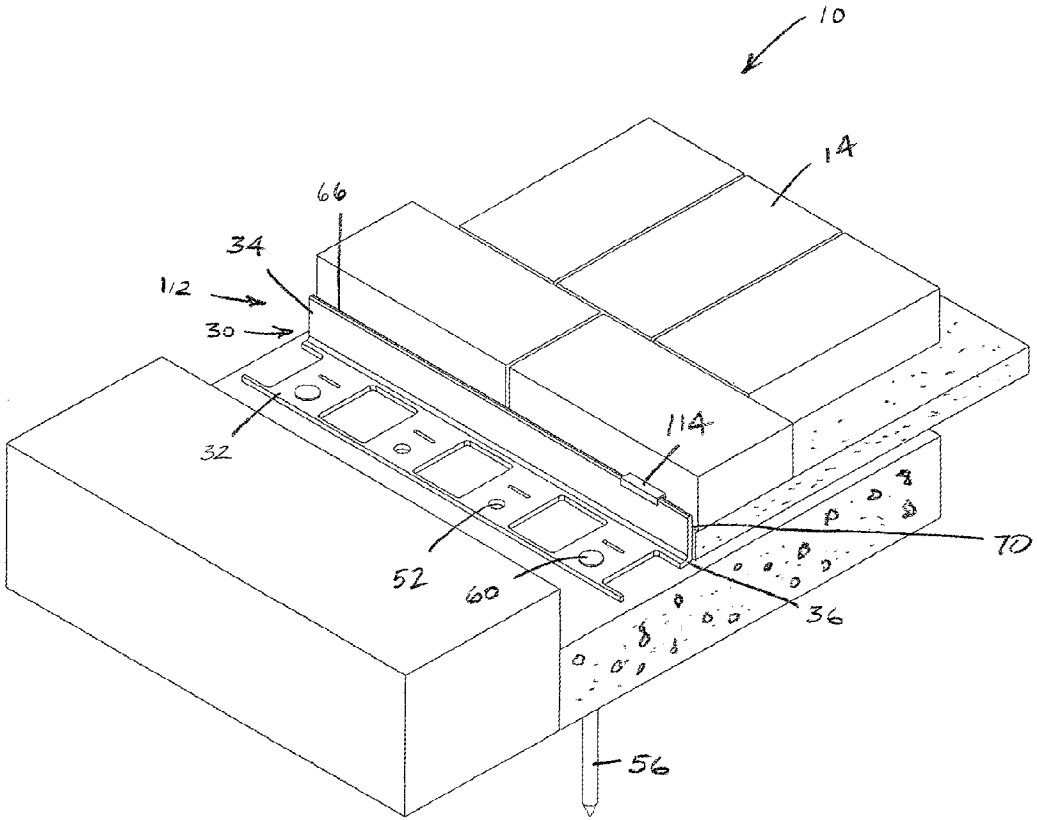
FIG. 2 is a perspective view of a unit pavement system and a novel edging system.

FIG. 2 depicts the unit pavement system 10 as shown in FIG. 1 and a novel edging system 112 to restrain the unit pavement system. The edging system 112 includes the edge restraint 30 shown in FIG. 1 having the horizontal section 32 and the vertical section 34 joined at the corner 36. The edging system 112 differs from the edging system 12 depicted in FIG. 1 through the use of a plate-like stake 114 operatively connected with the edge restraint 30. The plate-like stake 114 is more clearly visible in FIG. 3.

The edging system 112 depicted in FIG. 2 also differs from the edging system 12 depicted in FIG. 1 in that the plate-like state 114, and thus the edge restraint 30 operatively connected thereto, is retained by the weight of some of the paver units 14 of the unit pavement system 10 to restrain vertical and horizontal movement of the edge restraint 30.

Figure 3:
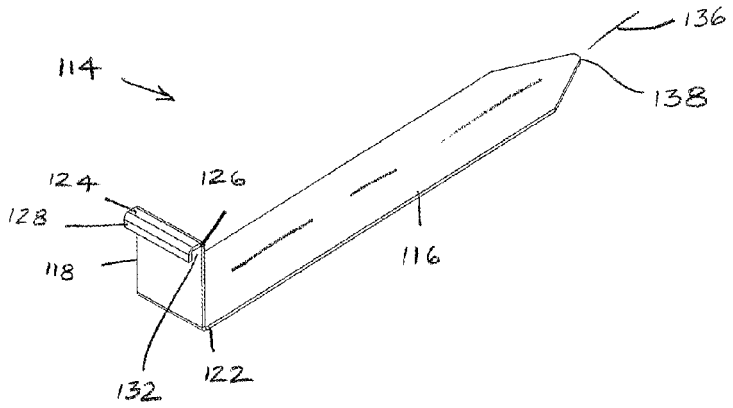
FIG. 3 is a perspective view of a plate-like stake of the edging system depicted in FIG. 2.

With reference to FIG. 3, the plate-like stake 114 includes a main body section 116, which is typically horizontally disposed when installed, and a vertical section 118 extending upwardly from a proximal end 122 of the main body section 116. The plate-like stake 114 further includes a cap section 124, which is horizontally oriented and extends from an upper edge 126 of the vertical section 118 in a direction opposite the direction in which the main body section 116 extends from the vertical section. The plate-like stake 114 also includes a vertical segment 128, which depends downwardly from the horizontal cap section and is spaced from the vertical section 118 to form a slot 132 defined by the vertical segment 128, the horizontal cap section 124, and the vertical section 118. The main body section 116 defines a central longitudinal axis 136.

The plate-like stake 114 depicted in FIG. 3 is made of one piece of material. For example, the plate-like stake 114 could be formed from a bent piece of thin-gauge metal. Alternatively, the plate-like stake 114 can be formed from a molded plastic or other composite material. It can be desirable to form the plate-like stake 114 from a material capable of bending along the central longitudinal axis 136 to form a curve in a plane normal to the main body section 116 and the vertical section 118. This can facilitate insertion of the main body section underneath the paver unit 14. The main body section 116 also includes a distal end 138 spaced from the proximal end 122, which can be tapered to a rounded point. The rounded point can be easier to install after the unit pavement system 10 installation is complete. A more pointed end can get caught on the aggregate, while the rounded point provides more ability for the main body section 116 to veer.

The vertical section 118 extends upwardly from and perpendicular to the main body section 116. The vertical section 118 extends from the main body section 116 a height about equal to the height of the vertical section 34 of the edge restraint 30. The horizontal cap section 124 and the vertical segment 128 can make up a flange that extends away from the vertical section 118 to engage the vertical section 34 of the edge restraint 30. More particularly, the horizontal cap section 124 is configured to engage the upper edge 66 of the edge restraint 30 when the edging system 112 is finally installed. The vertical segment 128 can also contact the vertical section 34 of the edge restraint 30 to limit movement of the edge restraint over time.

A method of installing the edging system 112 will be described with reference to FIGS. 2-5. The edging system 112 provides a system that can be installed before, during, or after the installation of the unit pavement system 10. The edging system 112 also provides a connection between two adjoining edge restraints that do not have an integrated connective method in their design, which is shown in FIG. 5. Even though the method will be described with reference to the edge restraint 30, the plate-like stake 114 shown in FIG. 3 can be used with other types of metal or synthetic "L" type edge restraints that have a vertical section that is integrally attached or clipped to a horizontal support base flange with anchoring points.

Figure 4:
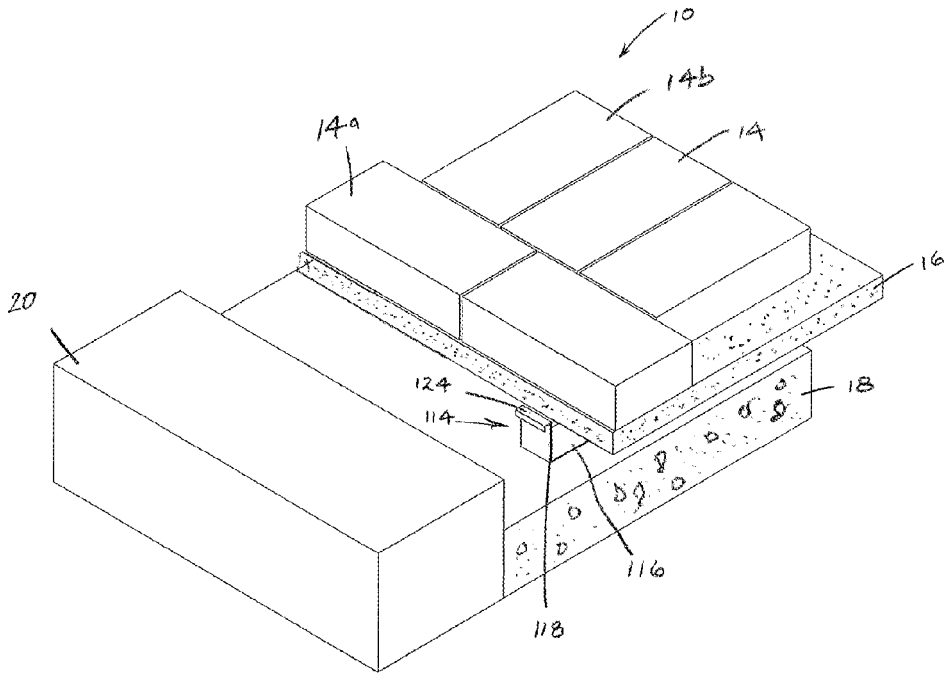
FIG. 4 is a perspective view of the plate-like stake inserted beneath paving units of the unit pavement system.
Figure 5:
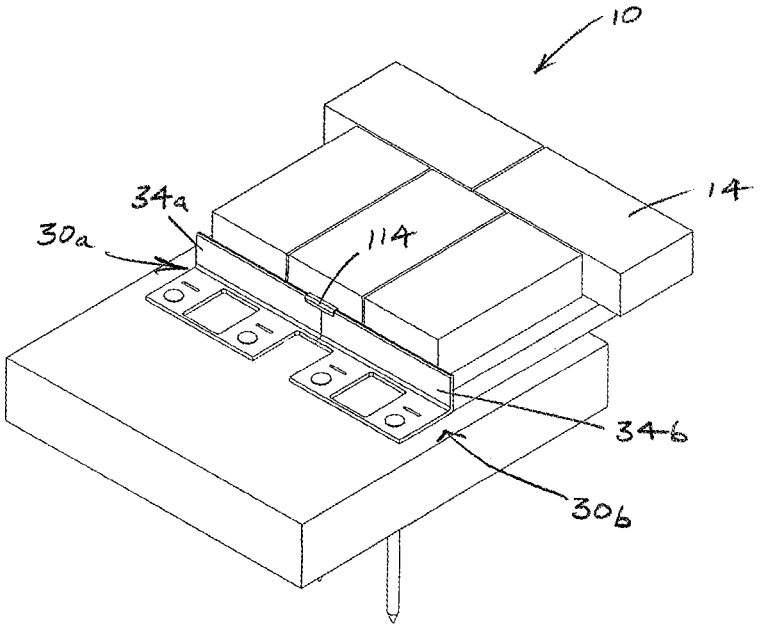
FIG. 5 is a perspective view of a unit pavement system and the edging system of FIG. 2 with the plate-like stake contacting ends of respective edge restraints similar to the edge restrains shown in FIG. 2.

With reference to FIG. 4, the plate-like stakes 114 can be positioned near where a finished edge of the unit pavement system 10 is designed to be. The sand layer 16 can be screeded on top of the larger aggregate layer 18 and removed from on top of the aggregate layer 18 between a location at or near the finished edge of the unit pavement system 10 and the finished grade 20. The plurality of paver units 14 can be installed to near their finished edge. If desired, the paver units 14 can be overlaid past a finish line and cut with a portable saw along the finish line to form a finished edge. After installation of the unit pavement system 10 is finished, the main body section 116 of the plate-like stake 114 can be inserted in a generally horizontal direction underneath at least one paver unit 14 of the plurality of paver units and into the granular material layer 16, 18 upon which the unit pavement system 10 is supported. Where the paver unit 14*a* in FIG. 4 depicts an outer paver unit, i.e., a paver unit along the periphery and/or the finished edge of the unit pavement system 10, and the paver unit 14*b* depicts an inner paver unit, the main body section 114 can be inserted underneath the inner paver unit 14*b*. In this way the main body section 114 spans a joint between the outer paver unit 14*a* and the inner paver unit 14*b*, which provides more resistance to movement in comparison to being underneath only the outer paver unit 14*a*.

If there is sufficient room between the finished grade 20 and the finished edge of the unit pavement system 10, the main body section 116 can be pushed horizontally into the granular material 16. As mentioned above, the main body section 116 can also be made from a somewhat flexible material so that the main body section can bend along the central longitudinal axis 136 while being inserted underneath the paver units 14. The main body section 116 of the plate-like stake 114 can also be rotated about a vertical axis while inserting the main body section underneath the paver units 14. The main body section 116 is inserted in the generally horizontal direction underneath the paver units 14 until the vertical section 118 of the plate-like stake contacts the edge of the unit pavement system 10.

After the vertical section 118 of the plate-like stake 114 is brought into contact with the edge of one of the paver units 14 of the unit pavement system 10, the edge restraint 30 is positioned under the horizontal cap section 124 of the plate-like stake until the vertical section 34 of the edge restraint 30 is arranged parallel to the vertical section 118 of the plate-like stake and is underneath the horizontal cap section. To position the edge restraint 30 under the horizontal cap section 124, the edge restraint 30 may need to be tilted about a horizontal axis, which can be generally aligned with the corner 36, so that the upper edge 66 of the vertical section 34 is closer to the finished edge of the unit pavement system 10 as compared to the corner 36. With the upper edge 66 of the vertical section 34 of the edge restraint 30 positioned within the notch 132 (FIG. 3), the corner 36 of the edge restraint can be brought towards the finished edge of the unit pavement system 10. Since the height of the vertical section 118 of the plate-like stake 114 is about equal to the height of the vertical section 34 of the edge restraint 30, the upper edge 66 of the edge restraint 30 can contact the horizontal cap section 124. The spacing between the vertical segment 128 and the vertical section 118 of the plate-like stake 114 in a horizontal direction is slightly larger than the thickness as measured in the horizontal direction of the vertical section 34 of the edge restraint 30. As such, the vertical section 34 of the edge restraint 30 can contact both the vertical segment 128 and the vertical section 118 of the plate-like stake 114, if desired.

With the edge restraint 30 properly positioned with respect to the plurality of paver units such that the paver-facing surface 70 is facing or contacting the finished edge of the unit paving system 10, the fasteners, e.g., nail spikes 56, can be driven into the ground surface (aggregate layer 18) until the fastener engages the horizontal section 32 of the edge restraint 30. Similar to the methods described above, the nail spike 56 can be driven through a nail spike opening 52 in the horizontal section 32 of the edge restraint 30 until a head 60 of the nail spike 56 contacts the horizontal section 32 adjacent the opening 52.

The plate-like stake 114 can also cross over joints between adjacent edge restraints 30*a*, 30*b* as shown in FIG. 5. As such, the plate-like stake 114 can provide a connection between the two adjoining edge restraints 30*a*, 30*b* where the edge restraints do not have an integrated connective method in their design. As such, the method of installing the edging system 112 can include positioning a vertical section 34*a* of the first edge restraint 30*a* under the horizontal cap section 124 (FIG. 3) of the plate-like stake 114 such that the vertical section 34*a* of the edge restraint is arranged parallel to the vertical section 118 (FIG. 3) of the plate-like stake 140 and underneath the horizontal cap section 124. The method can further include positioning a vertical section 34*b* of another edge restraint 30*b* under the horizontal cap section 124 (FIG. 3) of the plate-like stake 114 adjacent the edge restraint 30*a* already under the horizontal cap section of the plate-like stake so that the horizontal cap section covers end sections of two adjacent edge restraints.

Figure 6:
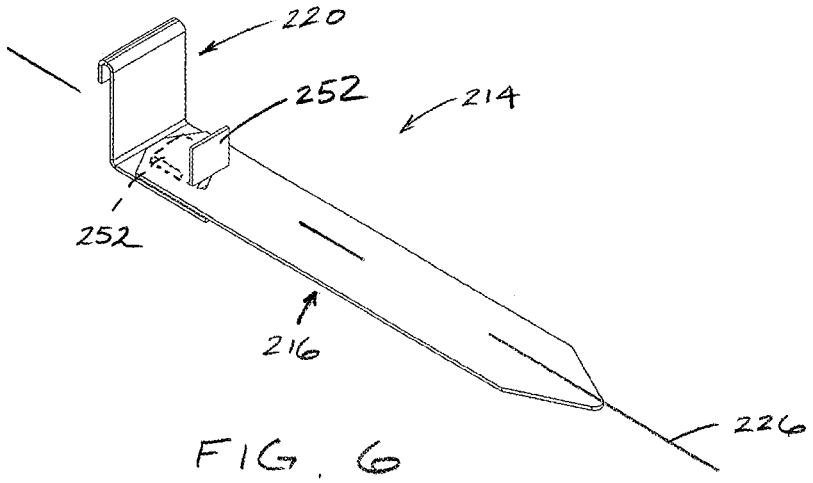
FIG. 6 is a perspective view of another embodiment of a plate-like stake shown in a first configuration.
Figure 7:
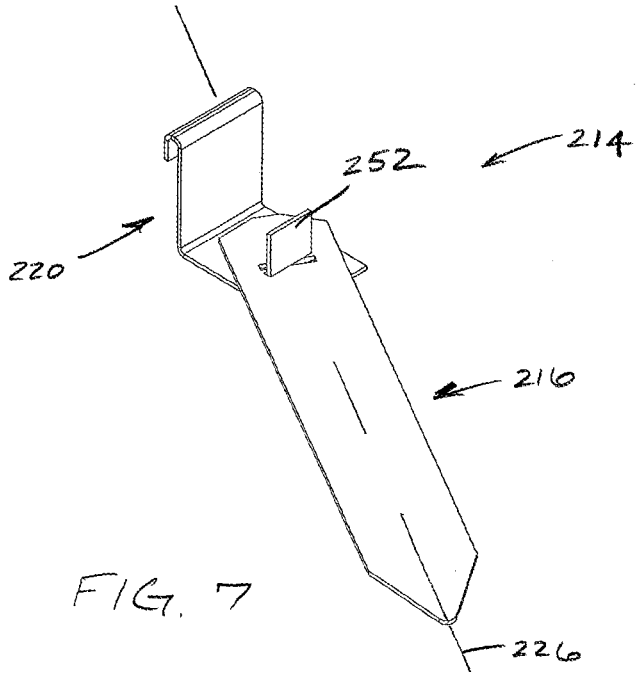
FIG. 7 is a perspective view of the plate-like stake shown in FIG. 6 in a different configuration.

FIGS. 6 and 7 depict an alternative embodiment of a plate-like stake 214 for an edging system for a unit pavement system. The plate-like stake 214 can be used in conjunction with the edge restraint 30 depicted in FIGS. 1, 2 and 5. The plate-like stake 214 includes a main body section 216, which operates in a similar manner to the main body section 116 of the plate-like stake 114 described above. The plate-like stake 214 also includes a clip 220, which is separate from and connectable with the main body section 216. The main body section 216 is configured to be inserted beneath at least one paver unit of a plurality of paver units, similar to the main body section 116 as shown in FIGS. 2, 4 and 5. The clip 220 and the main body section 216 are configured to be connected such that the main body section extends away from the clip while the clip engages the edge restraint 30 (FIG. 2) in a similar manner as the stake 114 described with reference to FIGS. 2-5.

Figure 9:
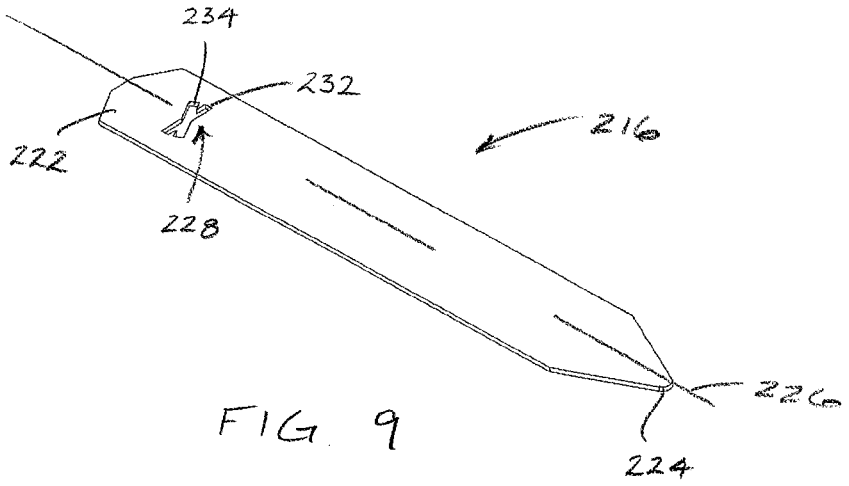
FIG. 9 is a perspective view of a main body section of the plate-like stake shown in FIGS. 6 and 7.

With reference to FIG. 9, the main body section 216 includes a proximal end 222 and a distal end 224. The distal end 224 can include a rounded point similar to the distal end 138 for the plate-like stake 114 shown in FIG. 3. The rounded point can be easier to install after the unit pavement system 10 installation is complete. A more pointed end can get caught on the aggregate, while the rounded point provides more ability for the main body section 216 to veer. The main body section 216 defines a central longitudinal axis 226. The main body section 216 is made from a material, such as metal or plastic, that is capable of bending along the central longitudinal axis in a plane that would be normal to the main body section. The main body section 216 also includes an opening 228 that allows for attachment of the main body section 216 to the clip 220. In the illustrated embodiment, the opening 228 is formed as two intersecting slots: a first slot 232 is disposed so as to extend generally perpendicular to the central longitudinal axis 226, and a second slot 234 is disposed at an angle offset from perpendicular to the central longitudinal axis 226. The second slot 234 is disposed at an angle with respect to the first slot 232. Each slot 232, 234 allows for connections of the main body section 216 to the clip 220.

Figure 8:
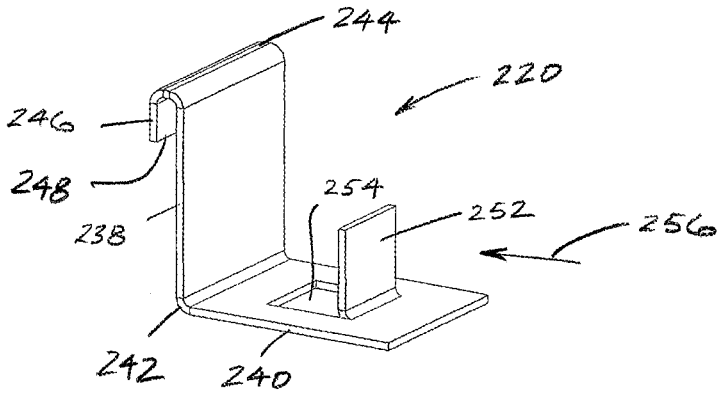
FIG. 8 is a perspective view of a clip of the plate-like stake shown in FIGS. 6 and 7.

With respect to FIG. 8, the clip 220, which is separate from the main body section 216, includes a vertical section 238 and a lower horizontal section 240. The vertical section 238 extends upwardly from the lower horizontal section 240 to form a corner 242. The vertical section 238 is similar to and performs a similar function as the vertical section 118 of the plate-like stake 114 shown in FIG. 3 when the plate-like stake 214 is finally assembled. The clip 220 further includes a cap section 244, which is generally horizontally disposed and spaced from the lower horizontal section 240 by the height of the vertical section 238. The horizontal cap section 244 extends away from the vertical section 238 in a direction opposite the direction that the lower horizontal section 240 extends from the vertical section. The clip 220 further includes a vertical segment 246, which extends downwardly from the horizontal cap section 244 so as to define a notch 248 similar to the notch 132 for the plate-like stake 114 shown in FIG. 3.

The clip 220 shown in FIG. 8 is one piece of formed metal. The clip 220 also includes a tab 252 that extends upwardly from the lower horizontal section 240. The tab 252 is punched out of the lower horizontal section 240 so as to form an opening 254 through the lower horizontal section 240. The opening 228 in the main body section 216 is configured to receive the tab 252. More particularly, the tab 252 is received either in the first slot 232 or the second slot 234 depending on the desired orientation of the main body section 216 with respect to the clip 220. The tab 252 is configured to be bent when a force in a direction of arrow 256 (FIGS. 6 and 8) is applied to the tab 252 after the tab has been inserted into one of the slots 232, 234. The tab 252 is shown as bent in phantom in FIG. 6. Once the tab 252 is bent so as to engage the main body section 216, the main body section is then connected with the clip 220 so that the clip 220 and the main body unit 216 act as an integral unit similar to the plate-like stake 140 shown in FIG. 3.

FIG. 6 depicts the tab 252 received through the first slot 232 of the main body section 216. FIG. 7 depicts the tab 252 received through the second slot 234 of the main body section 216. The main body section 216 could be rotated about the central longitudinal axis 226 so that the lower side shown in FIG. 7 is now the upper side and then again inserted through the second slot 234 to cant the main body section 216 in an opposite direction than that shown in FIG. 8. Canting the main body section 226 so that the central longitudinal axis 216 is not normal with the vertical section 238 of the clip 220 can allow the main body section to bridge over more joints between adjacent paver units. In another alternative, the main body section 216 could be formed to include the tab similar to the tab 252 shown for the clip 220 and the clip could include the opening similar to the opening 228 with the two slots 232 and 234. In other words, the main body section 216 could include one of an opening and a tab and the clip 220 could include the other of the opening and the tab. The tab 252 would operate in a similar manner and be inserted into one of the slots 232 or 234 depending on the desired orientation of the main body section 216 with respect to the clip 220. In either configuration, however, it would be desirable to have the main body section 216 rest on top of the lower horizontal section 240 of the clip 220. This would inhibit rotation of the clip 220 about an axis generally around a corner 242 of the clip because the weight of the paver units on top of the main body section 216 would counteract this rotational movement.

Figure 10:
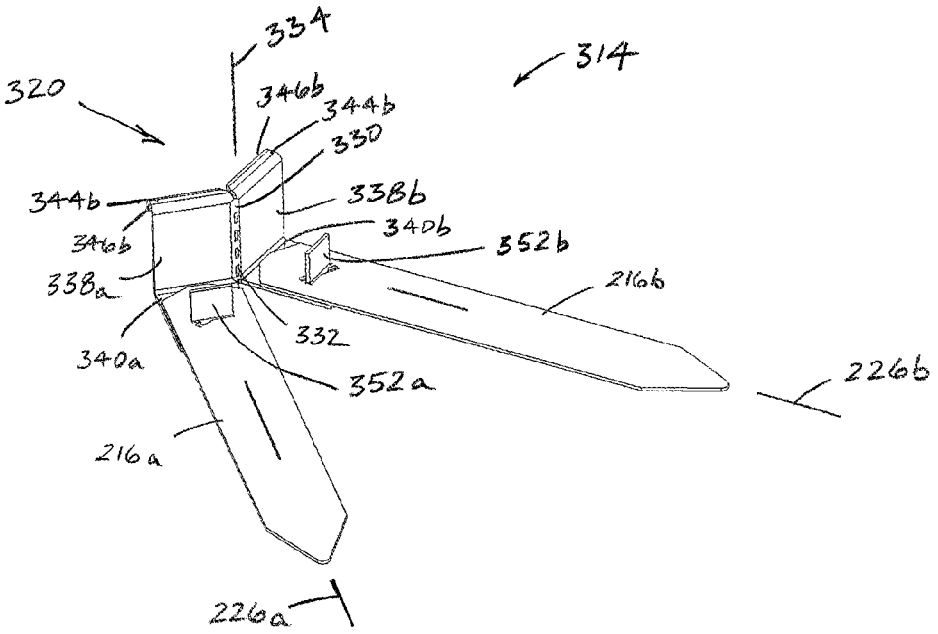
FIG. 10 is a perspective view of another embodiment of a plate-like stake.
Figure 11:
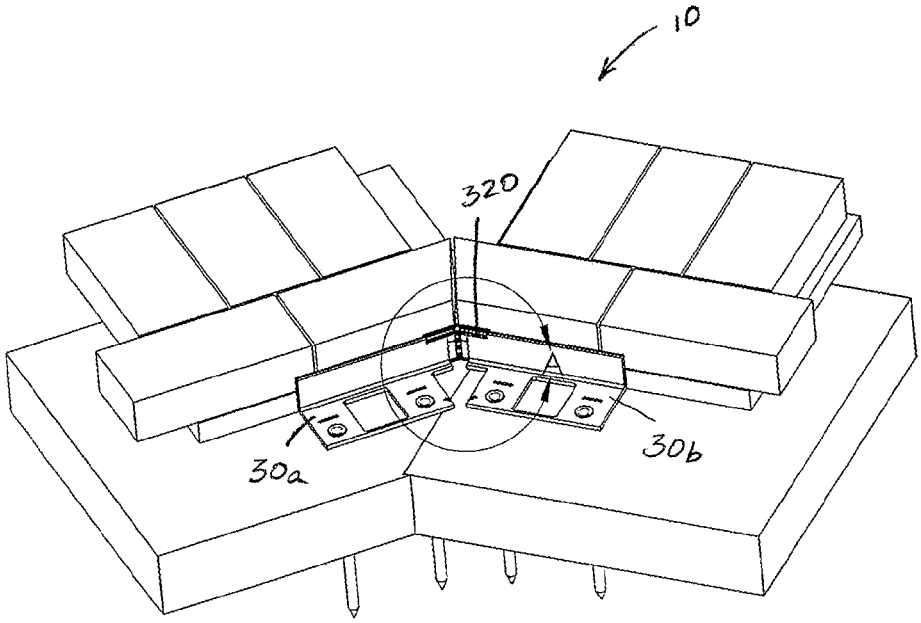
FIG. 11 is a perspective view of a unit pavement system and another edging system including a plate-like stake similar to that shown in FIG. 10.
Figure 12:
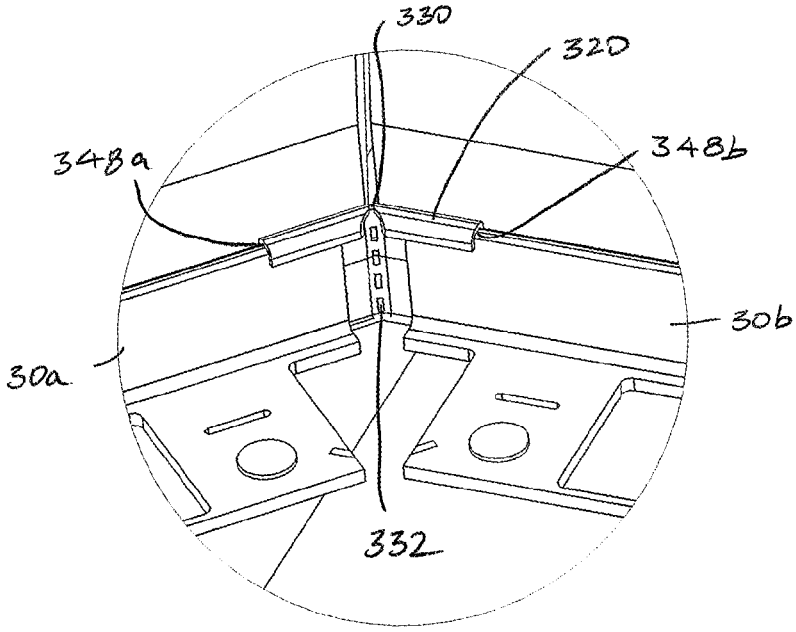
FIG. 12 is a close-up view of the circled portion of FIG. 11.

FIG. 10 depicts another plate-like stake 314 that can be used in conjunction with the edge restraint 30 depicted in FIGS. 1, 2 and 5. The plate-like stake 314 is useful for placement in corners of the unit pavement system 10 where two adjacent edge restraints 30*a*, 30*b* meet such as shown in FIGS. 11 and 12. The plate-like stake 314 includes a main body sections 216*a* and 216*b*, which are identical to the main body section 216 of the plate-like stake 214 described above. The plate-like stake 314 also includes a clip 320, which is separate from and connectable with the main body sections

216*a* and 216*b*. The clip 320 and the main body sections 216*a* and 216*b* are configured to be connected in the same manner as the clip 220 and the main body section 216 described above.

The clip 320 includes a hinge section 330 having a plurality of openings 332. The hinge section 330 is positioned between vertical sections 338*a* and 338*b* of the clip 320. The hinge section 330 allows the clip 320 to be bent about a vertical axis 334 to change the orientation of the left vertical section 338*a* (per the orientation of FIG. 10) and the right vertical section 338*b* based on the layout of the unit pavement system. The clip 320 includes lower horizontal sections 340*a*, 340*b*, cap sections 344*a*, 344*b*, and vertical segments 346*a*, 346*b* that are identical in configuration to and perform the same functions as those described with reference to FIG. 6. As seen in FIG. 12, notches 348*a* and 348*b* are formed by the clip 320 to receive the edge restraints 30*a*, 30*b*. The clip 320 also includes tabs 352*a*, 352*b*, which are identical to the tab 252 described above.

The clip 320 shown in FIG. 10 is one piece of formed metal. The piece of metal is punched between the vertical sections 338*a* and 338*b* to form the openings 332 in the hinge section 330. The piece of metal is cut between the lower horizontal sections 340*a*, 340*b* and between the flanges made up of the cap sections 344*a*, 344*b*, and vertical segments 346*a*, 346*b* to allow them to separate when the clip 320 is bent about the vertical axis 334. The orientation of the plate-like stake 314 shown in FIG. 10 can be changed to accommodate a different angle between the vertical sections 338*a* and 338*b* so that the central longitudinal axes 226*a* and 226*b* are at a different angle with respect to each other. Due to the thin thickness of the main body sections 216*a*, 216*b* and the lower horizontal sections 340*a*, 340*b*, it is possible that the main body sections 216*a* and 216*b* overlap, i.e., the central longitudinal axes cross, for example at a 90 degree corner of the unit pavement system.

Figure 13:
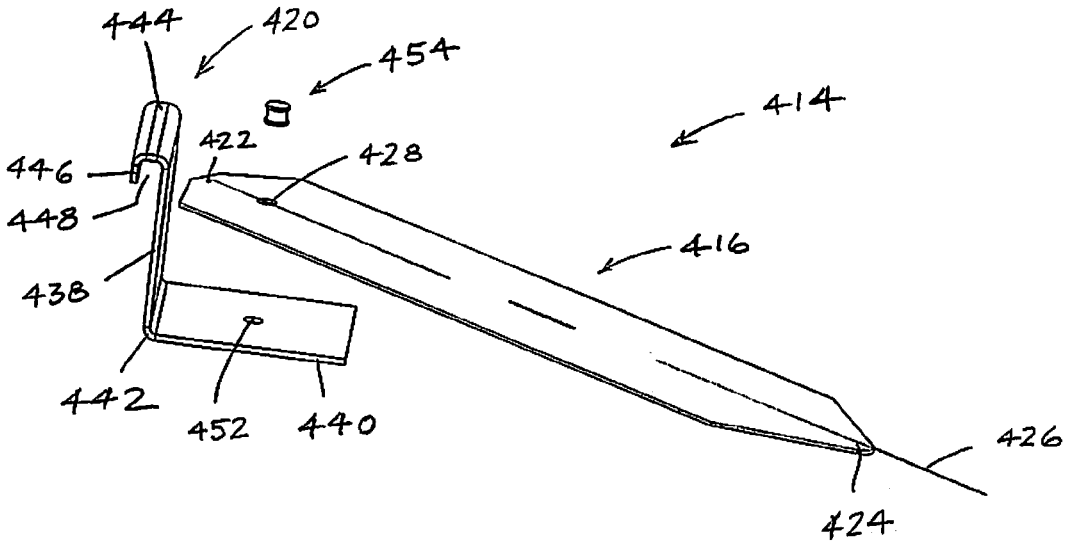
FIG. 13 is an exploded view of another embodiment of a plate-like stake.
Figure 14:
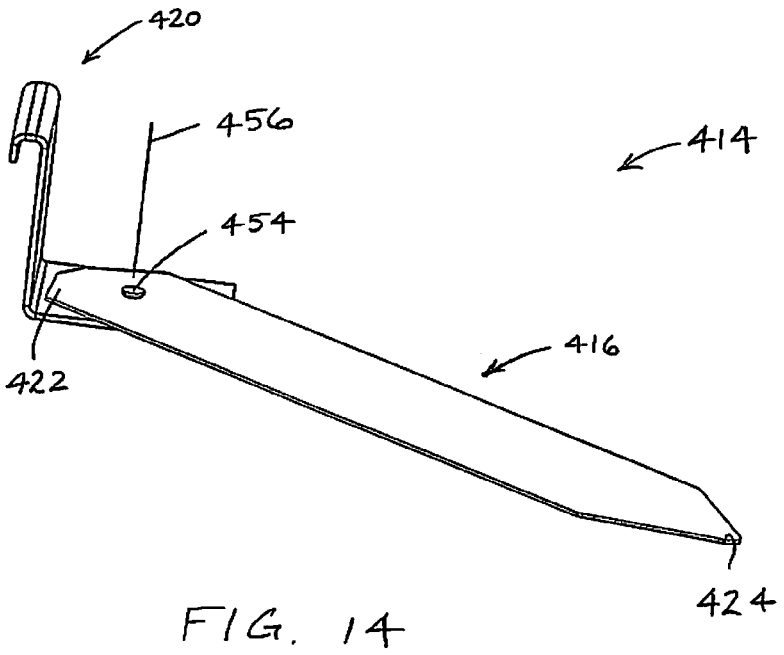
FIG. 14 is a perspective view of the plate-like stake shown in FIG. 13 as assembled.

FIGS. 13 and 14 depict another embodiment of a plate-like stake 414 for an edging system for a unit pavement system. The plate-like stake 414 can be used in conjunction with the edge restraint 30 depicted in FIGS. 1, 2 and 5. The plate-like stake 414 includes a main body section 416, which is shaped similarly to and operates in a similar manner as the main body section 116 of the plate-like stake 114 described above. The plate-like stake 414 also includes a clip 420, which is separate from and connectable with the main body section 416. The main body section 416 is configured to be inserted beneath at least one paver unit of a plurality of paver units, similar to the main body section 116 as shown in FIGS. 2, 4 and 5. The clip 420 and the main body section 416 are configured to be connected such that the main body section extends away from the clip while the clip engages the edge restraint 30 (FIG. 2) in a similar manner as the stake 114 described with reference to FIGS. 2-5.

With reference to FIG. 13, the main body section 416 includes a proximal end 422 and a distal end 424. The proximal end 422 is shown having chamfered corners, which allows for more rotation of the main body section 416 with respect to the clip 420 as compared to if the corners were not chamfered. The proximal end 422 could also follow an arc, for example following a radius of a later described opening 428. The distal end 424 can include a rounded point similar to the distal end 138 for the plate-like stake 114 shown in FIG. 3. The rounded point can be easier to install after the unit pavement system 10 installation is complete. A more pointed end can get caught on the aggregate, while the rounded point provides more ability for the main body section 416 to move freely through the aggregate. The main body section 416 defines a central longitudinal axis 426. The main body section 416 can be made from a material, such as metal or plastic, that is capable of bending along the central longitudinal axis 426 in a plane that would be normal to the main body section. The main body section 416 also includes an opening 428 that facilitates attachment of the main body section 416 to the clip 420.

With continued reference to FIG. 13, the clip 420, which is separate from the main body section 416, includes a vertical section 438 and a lower horizontal section 440. The vertical section 438 extends upwardly from the lower horizontal section 440 to form a corner 442. The vertical section 438 is similar to and performs a similar function as the vertical section 118 of the plate-like stake 114 shown in FIG. 3 when the plate-like stake 414 is finally assembled. The clip 420 further includes a cap section 444, which is generally horizontally disposed and spaced from the lower horizontal section 440 by the height of the vertical section 438. The horizontal cap section 444 extends away from the vertical section 438 in a direction opposite the direction that the lower horizontal section 440 extends from the vertical section. The clip 420 further includes a vertical segment 446, which extends downwardly from the horizontal cap section 444 so as to define a notch 448 similar to the notch 132 for the plate-like stake 114 shown in FIG. 3.

The clip 420 shown in FIGS. 13 and 14 is one piece of formed metal. The clip 420 also includes an opening 452 in the lower horizontal section 440. The opening 452 can be punched out of the lower horizontal section 440. The opening 428 in the main body section 416 aligns with the opening 452 in the clip 420. The plate-like stake 414 also includes a fastener 454 connecting the clip 420 with the main body section 416. The fastener 454 is received in the opening 428 in the main body section 416 and in the opening 452 in the clip 420. When connected, the main body section 416 rests on and contacts the lower horizontal section 440 of the clip 420. The fastener 454 engages both the clip 420 and the main body section 416 so that the clip 420 and the main body section 416 act as an integral unit similar to the plate-like stake 140 shown in FIG. 3. The fastener 416 is shown in FIGS. 13 and 14 as a rivet; however, other fasteners, e.g., a screw, a grommet or a pin, would suffice. It is desirable, however, that the fastener 454 not extend too far above, e.g., be substantially flush with, an upper surface of the main body section 416, since the fastener 454 and the lower horizontal section 440 of the clip 420 will also be located beneath the paver units.

When the main body section 416 is connected with the clip 420, the main body section 416 is pivotable with respect to the clip 420 about a pivot axis 456 (FIG. 14) aligned with the fastener 454. Canting the main body section 416 so that the central longitudinal axis 426 is not normal with the vertical section 438, which is planar, of the clip 420 can allow the main body section 416 to bridge over more joints between adjacent paver units. It is desirable that the pivotal connection between the main body section 416 and the clip 420 is not a particularly loose pivotal connection. It is desirable that the main body section 416 be movable with respect to the clip 420 through a typical manual force that could be exerted by a construction worker installing the unit pavement system. The connection, however, should not be so loose, e.g., that the main body section 416 would move due to the force of gravity if the clip 420 was rotated so that the lower horizontal section 440 resided in a vertical plane. This will inhibit the main body section 416 from moving with respect to the clip 420 when the main body section is being inserted underneath the paver units.

It will be appreciated that various presently unforeseen or unanticipated alternatives, modifications, variations or improvements in the aforementioned embodiments may be subsequently made by those skilled in the art which are also intended to be encompassed by the following claims.

The invention claimed is:

1. A method of installing an edging system for a unit pavement system, the method comprising:

inserting in a generally horizontal direction underneath at least one paver unit of a plurality of paver units and into a granular material layer upon which the unit pavement system is supported a main body section of a stake, which includes the main body section and a clip connected with the main body section, the clip including a vertical section extending upwardly form the main body section and a horizontal cap section extending away from the vertical section and vertically offset from the main body section, and inserting the main body section of the stake until the vertical section of the clip contacts an edge of the at least one paver unit;

positioning a vertical section of an edge restraint, which includes a horizontal section and the vertical section joined at a corner, under the horizontal cap section such that the vertical section of the edge restraint is arranged parallel to the vertical section of the clip and underneath the horizontal cap section; and driving a fastener into a ground surface until the fastener engages the horizontal section of the edge restraint.

2. The method of claim 1, wherein positioning the edge restraint further includes positioning the edge restraint against a finished edge, which is formed by a cutting process whereby the paver units are overlaid past a finish line and cut with a portable saw along the finish line to form the finished edge.

3. The method of claim 1, further comprising positioning a vertical section of another edge restraint under the horizontal cap section adjacent the edge restraint already under the horizontal cap section so that the horizontal cap section covers each vertical section of end sections of two adjacent edge restraints.

4. The method of claim 1, wherein the main body section is pivotable with respect to the clip about a vertical pivot axis.

5. The method of claim 1, wherein the clip is a single piece of material including the vertical section interconnected with the horizontal cap section.

6. The method of claim 5, wherein the clip further includes a lower horizontal section offset from the horizontal cap section, wherein the main body section is connectable with the clip in a manner such that a central axis of the main body section is able to be offset from the vertical section of the clip at an angle other than 90 degrees as measured in the plane parallel to the lower horizontal section of the clip.

7. The method of claim 5, further comprising a fastener connecting the clip with the main body section.

8. The method of claim 7, wherein the main body section is pivotable with respect to the clip about a pivot axis aligned with the fastener.

9. The method of claim 8, wherein the fastener is a rivet.

10. An edging system for a unit pavement system comprising:

an edge restraint including a horizontal section and a vertical section joined at a corner, the vertical section extending upwardly from and generally perpendicular to the horizontal section and defining a paver—facing surface configured to face toward an edge of the unit pavement system; and a stake configured to engage with the edge restraint, wherein the stake includes a horizontal main body section sufficiently rigid so as to be inserted into coarse sand or aggregate underneath paver units of the unit pavement system, wherein the stake includes a stake vertical section extending upwardly from the horizontal main body section and a horizontal cap section extending away from the stake vertical section and vertically offset from the horizontal main body section, wherein the stake is an assembly including a clip, which is separate from the main body section, connected with the main body section, wherein the clip includes the stake vertical section and the horizontal cap section.

11. The edging system of claim 10, wherein the clip includes a vertical segment extending downwardly from the horizontal cap section and offset horizontally from the stake vertical section, wherein the vertical segment is shorter in a vertical dimension as compared to the stake vertical section such that the edge restraint is capable of being slid underneath the vertical segment to fit into a slot defined between the stake vertical section and the vertical segment.

12. The edging system of claim 10, wherein the main body section is pivotable with respect to the clip about a vertical pivot axis.

13. The edging system of claim 10, wherein the stake further includes a fastener connecting the clip with the main body section.

14. The edging system of claim 13, wherein the main body section is pivotable with respect to the clip about a pivot axis aligned with the fastener.

15. A stake for an edging system for a unit pavement system, the stake comprising:

a main body section configured to be inserted beneath at least one paver unit of a plurality of paver units;

a clip, which is separate from the main body section, including a vertical section, a horizontal cap section extending away from the vertical section, and a lower horizontal section offset from the horizontal cap section, wherein the main body section connects with the clip in a manner such that a central axis of the main body section is able to be offset from the vertical section of the clip at an angle other than 90 degrees as measured in the plane parallel to the lower horizontal section of the clip.

16. The stake of claim 15, wherein the main body section includes one of an opening and a tab and the clip includes the other of the opening and the tab, wherein the opening is configured to receive the tab, and the tab is configured to be bent to engage either the main body section or the clip.

17. The stake of claim 15, wherein further comprising a fastener connecting the clip with the main body section.

18. The stake of claim 17, wherein the fastener is a rivet.

19. The stake of claim 15, wherein the main body section is pivotable with respect to the clip about a pivot axis when connected with the clip.

20. A stake for an edging system for a unit pavement system, the stake comprising:

a vertically thin main body section configured to be inserted beneath at least one paver unit of a plurality of paver units;

a clip, which is separate from the main body section, including a vertical section, a horizontal cap section extending away from the vertical section, and a lower horizontal section offset from the horizontal cap section, wherein the main body section is connected with the clip and pivotable with respect to the clip about a vertical pivot axis.

* * * * *